US008844164B2

(12) United States Patent
Turner

(10) Patent No.: US 8,844,164 B2
(45) Date of Patent: Sep. 30, 2014

(54) FOLDABLE PROTECTIVE OVERSHOE AND METHOD OF MANUFACTURING

(75) Inventor: Zain Turner, Pointe-Claire (CA)

(73) Assignee: 9225-6619 Quebec Inc., Pointe-Claire, QC (CA)

( * ) Notice: Subject to any disclaimer, the term of this patent is extended or adjusted under 35 U.S.C. 154(b) by 264 days.

(21) Appl. No.: 13/592,587

(22) Filed: Aug. 23, 2012

(65) Prior Publication Data

US 2013/0047460 A1 Feb. 28, 2013

Related U.S. Application Data

(60) Provisional application No. 61/526,492, filed on Aug. 23, 2011, provisional application No. 61/602,789, filed on Feb. 24, 2012.

(51) Int. Cl.
*A43B 3/16* (2006.01)
*A43B 13/22* (2006.01)

(52) U.S. Cl.
CPC .. *A43B 3/16* (2013.01); *A43B 13/22* (2013.01)
USPC ..... 36/7.1 R; 36/69; 36/138

(58) Field of Classification Search
CPC ..... A43B 3/16; A43B 11/00; A43B 11/02; A43B 23/08; A43B 23/088
USPC ..... 36/7.1 R, 7.2, 7.3, 7.4, 138, 68, 69
See application file for complete search history.

(56) References Cited

U.S. PATENT DOCUMENTS 151,970 A * 6/1874 Hall ..... 36/7.3
1,119,277 A * 12/1914 Gross ..... 36/7.3
1,560,124 A * 11/1925 Volkey ..... 36/1
1,644,217 A 10/1927 Wreford
2,024,766 A 12/1935 Ingwer
2,102,265 A * 12/1937 Halberstadt ..... 36/7.3
2,504,705 A 4/1950 Leguillon
2,666,996 A * 1/1954 Odland ..... 36/50.1
3,146,535 A * 9/1964 Owings ..... 36/7.3
3,280,485 A * 10/1966 Arnold ..... 36/7.3
3,283,423 A * 11/1966 Schovee ..... 36/7.3
3,359,658 A 12/1967 Price
3,621,592 A * 11/1971 Goldmerstein ..... 36/138

(Continued)

OTHER PUBLICATIONS

"Rollini Road Overshoe" Chicken Cyclekit http://www.chickencycles.co.uk/index.php?cat=17&sub=25&ord=0 (Accessed: Jul. 8, 2011).

(Continued)

*Primary Examiner* — Marie Bays
(74) *Attorney, Agent, or Firm* — Norton Rose Fulbright Canada LLP

(57) ABSTRACT

A protective overshoe has a collapsible upper portion attached to a stretchable lower portion with a collapsible sole. The collapsible sole may be coated directly on the lower portion of a fabric overshoe body. The coating may be applied by dipping the lower portion of the fabric overshoe body into a bath of liquid rubber. Separate toe and heel outsole portions may be provided on the rubber coated lower portion of the fabric overshoe body. The lower portion may further comprise a reinforcing heel insert which is adapted to clip on the heel of the wearer's shoe while providing the required form holding properties to maintain an unobstructed heel opening when the lower portion of the overshoe is longitudinally stretched.

14 Claims, 11 Drawing Sheets

(56) References Cited

U.S. PATENT DOCUMENTS

| | | | | |
|---|---|---|---|---|
| 3,718,993 | A * | 3/1973 | Schovee | 36/87 |
| 4,516,336 | A | 5/1985 | Nissenbaum | |
| 4,896,438 | A | 1/1990 | DeBease | |
| 5,067,260 | A | 11/1991 | Jenkins, Jr. | |
| 5,315,767 | A * | 5/1994 | Bradbury | 36/7.1 R |
| 5,425,186 | A | 6/1995 | Hoyt | |
| 5,729,915 | A | 3/1998 | Khoo et al. | |
| 5,787,607 | A | 8/1998 | Schurch | |
| 5,813,149 | A * | 9/1998 | Baker et al. | 36/138 |
| 5,890,302 | A | 4/1999 | Kirkis | |
| 2006/0005426 | A1 | 1/2006 | Votolato | |
| 2006/0117598 | A1 * | 6/2006 | Czaplewski et al. | 36/2 R |

OTHER PUBLICATIONS

"Frogg Toggs Frogg Leggs Overshoe" Fish USA.com http://www.fishusa.com/Frogg-Toggs-Frogg-Leggs-Overshoe_p.html (Accessed: Jul. 8, 2011).

* cited by examiner

FOLDABLE PROTECTIVE OVERSHOE AND METHOD OF MANUFACTURING

CROSS-REFERENCE TO RELATED APPLICATIONS

The present application claims priority on U.S. Provisional Application No. 61/526,492, filed on Aug. 23, 2011 and U.S. Provisional Application No. 61/602,789, filed on Feb. 24, 2012, the entire content of which is incorporated herein by reference.

TECHNICAL FIELD

The application relates generally to overshoes and, more particularly, to a soft shell/collapsible overshoe.

BACKGROUND OF THE ART

It is known to wear galoshes/overshoes to protect shoes during undesirable weather conditions. With time overshoes were developed to cover the shoe and leg portion. Certain designs incorporate a mixture of stretchable and non-stretchable rubber and/or fabric materials. Typically, a fabric upper is stitched or otherwise attached to a separately formed lower rubber portion. Various efforts have been made to provide ease of use, while combining a stretchable sole portion, with a non-stretchable upper portion. Historically, this functional problem was initially overcome by providing a more dense rubber galosh bottom but with limited opening in the rear upper portion. Typically, the heel portion of the overshoe extended as one piece rubber like traditional galoshes and an opening is defined in an upper portion extending upwardly from the closed rubber heel portion. According to this design, the opening did not extend lower down through the rubber heel portion, which still gives difficulty on entry and removal. More so, with this dense rubber it was not possible to make the overshoe collapsible.

Other variations of the overshoe were developed, some being collapsible, some stretchable, some others with added rear openings but neglecting material compatibility and function.

There is thus a need for a new overshoe which is readily collapsible into a compact configuration and which can be easily fitted over different shoes.

SUMMARY

It is therefore an aim of the present invention to provide a readily portable and usable protective overshoe.

In one aspect, there is provided a protective overshoe comprising a soft waterproof fabric upper portion extending from a lower portion including a stretchable sole structure. A closure may extend vertically along the back of the overshoe down to a heel region thereof. The stretchable sole structure may comprise separate heel and toe portions interconnected by a flexible and stretchable intermediate portion. The flexible and stretchable intermediate portion allowing the heel and toe portion to be folded one over the other. The lower portion may further comprise a rigid heel insert including lateral wings adapted to grasp the heel portion of the wearer's shoe. A pull tab may be provided at the back of the over shoe to spread the lateral wings laterally apart during the insertion process of the wearer's shoe into the protective overshoe, the rigid heel insert thereby providing resistance against inward collapsing of the stretchable sole structure when subject to longitudinal stretching forces as during the shoe insertion process.

In a second aspect, there is provided a protective overshoe that is waterproof or water-resistant to afford protection to a variety of footwear. The overshoe has a foldable/collapsible upper portion and a lower portion including a sole portion which is made of flexible, stretchable materials. The upper and lower portions may be integrally formed from a fabric material with a water-resistant coating applied to fabric overshoe body. A closure extends vertically along a back surface of the overshoe, including the lower portion, to selectively provide a rear opening substantially along its entirety for access.

According to another aspect, the sole portion may be broken down into three separate parts, a reinforced heel portion, a toe portion and an intermediary stretchable area. The heel and toe areas being separate allow ease for compatibility and adaptability to various shoe forms. The sole portion is continuous in length and width and adapts above the toe, and along the inner and outer surfaces of the shoe rendering a snug three dimensional fit. The reinforced heel portion has a substantially solid structure, giving the back closure a distinctive rest. The solid structure further provides a built in "shoehorn" like effect in order to permit free and easy access of the shoe during use.

A tightening cord may be provided at a top rim of the upper portion of the overshoe. Along the inner surface of the top rim, the upper portion may contain a lightly textured rubber or other high friction material to provide resistance to gravitational forces and therefore the downwards collapse of the upper portion of the overshoe.

According to another aspect, the lower portion, including the outsole, may be obtained by dipping the lower portion of a fabric overshoe body or substructure into a bath of liquid rubber or other suitable materials. The coating could also be applied by spraying or brushing.

The entire substructure of the overshoe (i.e. template) may be fabricated, and then by way of dipping/coating of liquid rubber, features may be added, to provide desired properties such as extra abrasion and waterproofing qualities. Various rubbers (nitrile, latex, polyurethane, etc. . . . ) could be used, and offer an array for different properties. The use of various rubbers, or their mixtures, ultimately gives rise to various final products bearing unique qualities, such as the ability to stretch, abrasion resistance, temperature dependant properties, and grip. Further, these rubbers may not only be blended together, but with other elements such as silica for specific final textures. Also the number and order of dips/coats of rubber can create different outcomes of products such as varied thickness, differing texture lines and so forth. This manufacturing method may create a significantly more packageable and three dimensionally adaptable product. Both of which are directly related to eliminating the prefabricated sole portion of a traditional overshoe. Moreover, the ability to use various underlying (template) fabrics opposed to rubber alone allows further product variations. Such as, the use of Kevlar™ for cut resistance, and neoprene for temperature stability. The use of underlying fabric also ensures adequate stitching, fusion, adhesion of upper and lower overshoe portions, which is more predictable than stitching, fusion, adhesion directly to rubber alone. According to an aspect of the method of fabrication, the product (i.e. the overshoe substructure) is stitched together first, then the rubber coating covers the seems, thereby eliminating the need to waterproof the seems, as well as adding strength to the bond of the upper and lower portions According to a further general aspect, the overshoe may be provided in the form of a sock-like inner portion to the lower portion of which a rubber coating is applied, such as by dipping the sock-like inner portion into a bath of liquid rubber, to transition the garment into a more resistant product for overshoe function.

According to a further general aspect, there is provided a protective overshoe comprising a soft waterproof fabric upper portion extending from a lower portion including a stretchable sole structure, the lower portion being adapted to accommodate a wearer's shoe, the stretchable sole structure comprising a rubber coating applied on an underlying fabric structure integral to the soft waterproof fabric upper portion, a heel insert attached to the lower portion within the confines of a heel region thereof, the heel insert providing resistance against inward collapsing of the stretchable sole structure when subject to longitudinal stretching forces, the heel insert including a pair of lateral resilient wings adapted to clip around a heel portion of a wearer's shoe, and a pull tab attached at the back of the lower portion of the protective overshoe and connected to the lateral resilient wings of the heel insert to spread said lateral resilient wings backward away from each other during placement of the wearer's shoe inside the protective overshoe.

According to a still further general aspect, there is provided a collapsible overshoe comprising a soft collapsible shell having a stretchable lower portion configured to accommodate a wearer's shoe, a heel insert attached to said lower portion in a heel region thereof, the heel insert being more rigid than said stretchable lower portion, the heel insert having a pair of opposed lateral wings adapted to clip around a back portion of the wearer's shoe, and a pull tab connected to said heel insert for pulling said lateral wings apart to a position in which said lateral wings provides for a substantially unobstructed entry the back portion of the wearer's shoe between said lateral wings.

DESCRIPTION OF THE DRAWINGS

Reference is now made to the accompanying figures, in which.

DETAILED DESCRIPTION

Figure 1:
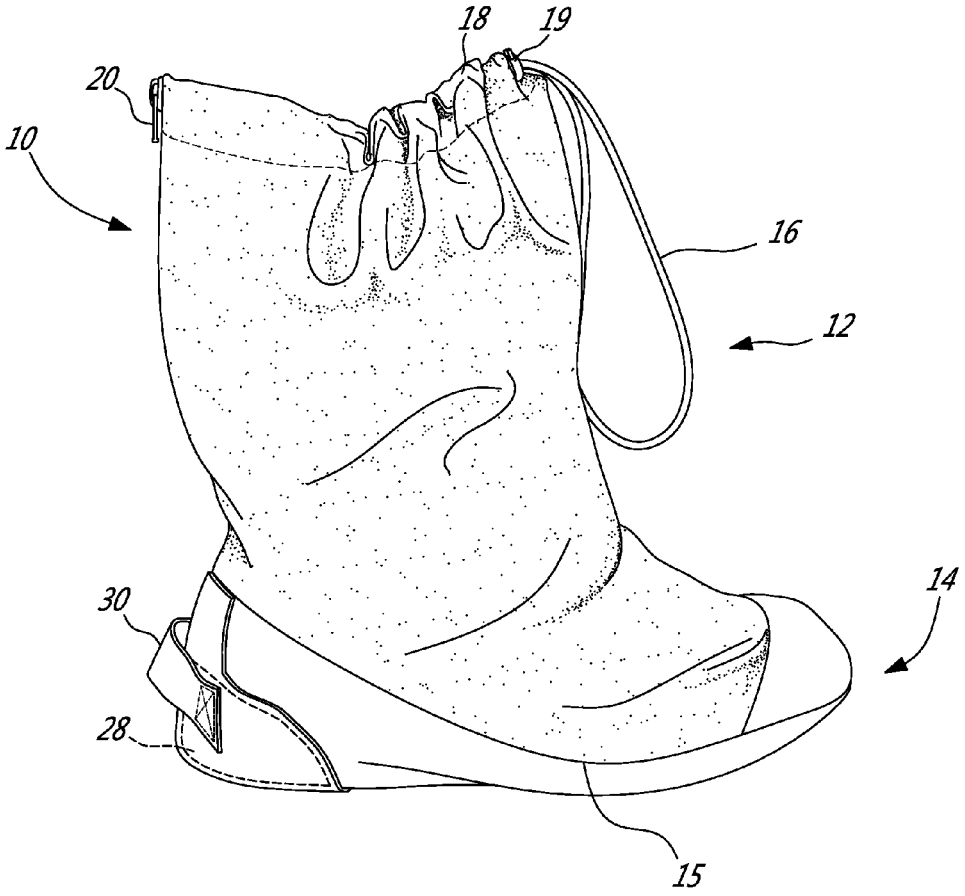
FIG. 1 is a side elevation view of a protective overshoe in accordance with an embodiment of the present invention.
Figure 2:
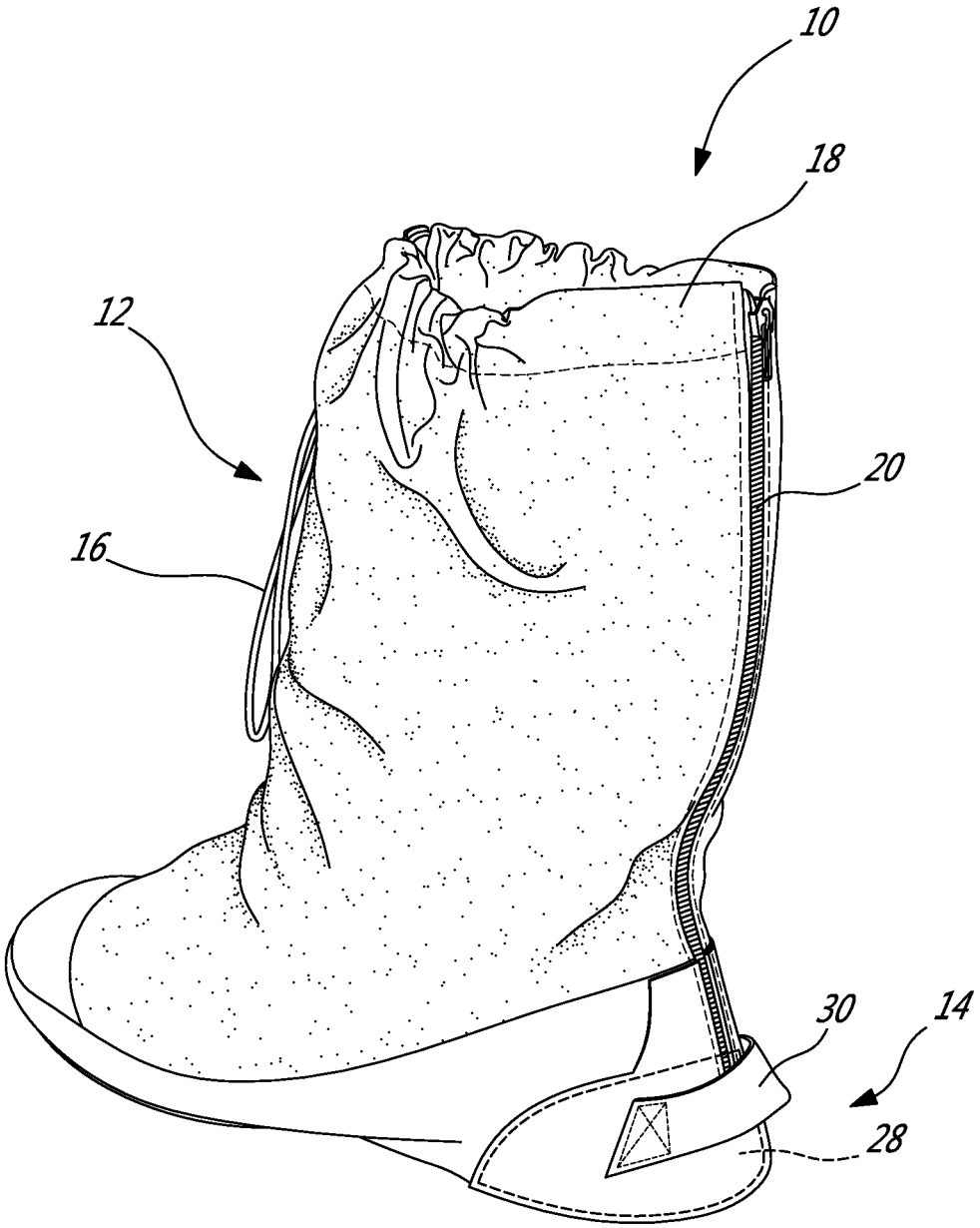
FIG. 2 is a rear perspective view of the protective overshoe shown in FIG. 1.
Figure 3:
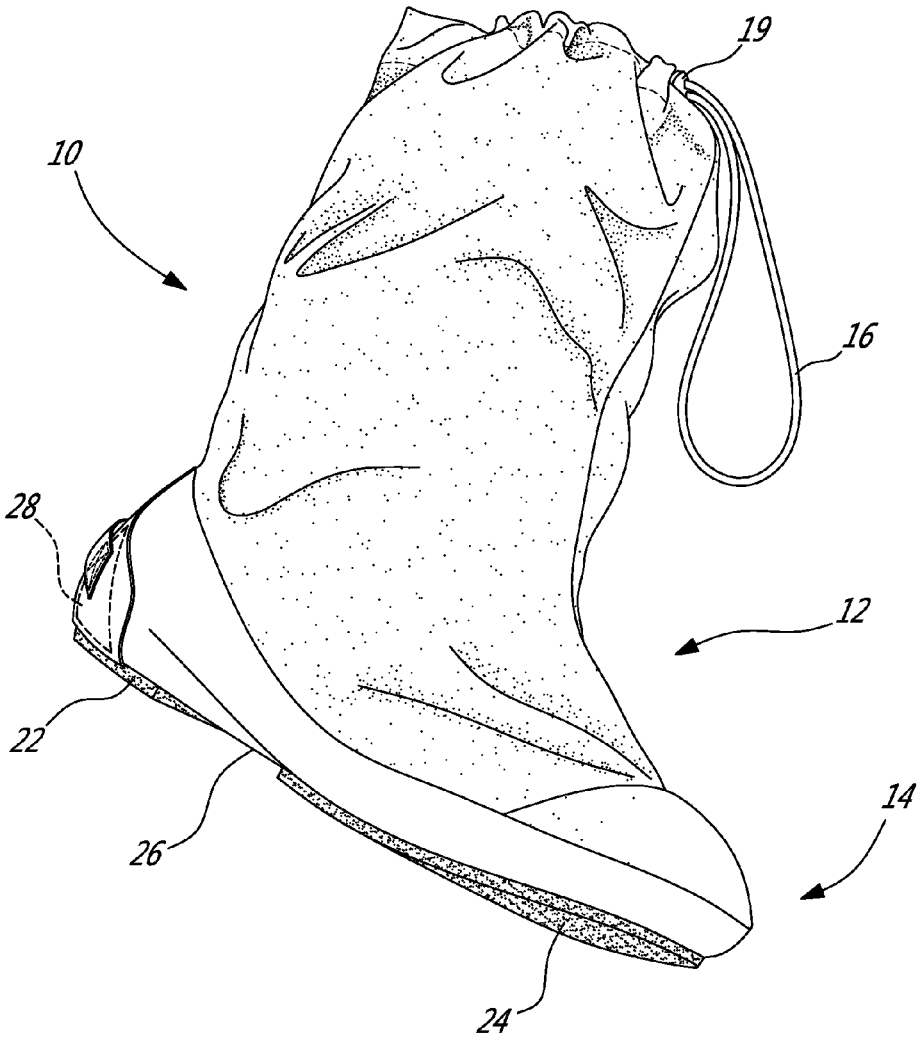
FIG. 3 is a front perspective view of the protective overshoe shown in FIG. 1.

FIGS. 1 to 8 illustrate an embodiment of a protective overshoe 10 which may be readily collapsed and folded in a compact configuration for carrying or storage in a pouch. The overshoe 10 is designed to be worn over conventional shoes or boots to provide among others waterproofing and dust/dirt proofing protection. The overshoe 10 generally comprises an upper portion 12 made of a lightweight collapsible/flexible waterproof fabric material which may be attached to a stretchable waterproof lower portion 14 via stitching 15, adhesive or other suitable means. As will be seen hereinafter with reference to FIGS. 10 to 12, the waterproof/stretchable lower portion 14 could also be obtained by applying a coating on a soft fabric overshoe substructure, thereby avoiding the need for fabricating two separate parts that subsequently need to be attached together, and/or using prefabricated rubber fabric, or custom die molds for construction. Further, this coating may be applied after the upper and lower portions of the fabric substructures are attached, and is placed specifically above the level of attachment so as to strengthen the attachment, and eliminate the requirement of waterproofing the attachment seems. Indeed, it might be advantageous to have the ability to build the waterproof lower portion, including the overshoe outsole, directly on an soft overshoe substructure.

As can be readily appreciated from FIGS. 1 to 3 and 6 to 9, the upper portion 12 may be provided in the form of a foldable/collapsible tubular leg encasing portion. A fastener, such as a drawstring 16, is provided at a top edge of the upper portion 12. The drawstring 16 may be used to gather the top open end of the upper portion 12 snugly around the wearer's leg, thereby preventing water or snow from entering inside the overshoe 10. The drawstring 16 also allows securing the upper portion 12 of the overshoe to the wearer's leg and, thus, preventing the upper portion 12 from vertically collapsing around the wearer's ankle when worn. In this way, the upper portion 12 may be designed to be quite flexible (i.e. no need for a stiff stand-alone structure) so as to readily fold up. A piece of friction material (not shown), such as textured rubber, may be provided on the inner surface of the top edge region of the upper portion 12 to resist against the upper portion 12 from sliding downwardly around the wearer's leg.

According to the illustrated embodiment, the drawstring 16 extends through a hem 18 formed at the top edge of upper portion 12. The hem 18 may be formed by folding over inwardly the free end of the upper portion 12 and by stitching, bonding or otherwise securing it in place. The drawstring 16 extends outwardly from the hem 18 at the front of the upper portion 12. A buckle 19 or the like may be provided to permit drawstring 16 to be drawn tight and released as desired. As can be appreciated from FIG. 2, the hem 18 may not need to extend along the full circumference of the upper portion 12. Indeed, the hem 18 extends circumferentially forwardly from opposed sides of a rear slit or opening extending vertically centrally along the back of the upper portion 12. A slide fastener 20 (e.g. a zipper) is provided to selectively close and open the slit at the back of the overshoe 10. The slide fastener 20 extends from the top edge of the upper portion 12 down within the confines of the stretchable lower portion 14 of the overshoe 10 to provide an unobstructed full-length entrance at the back of the overshoe 10. By drawing the slide fastener 20 down the entire length of the rear slit, substantially the entire back portion of the overshoe may be opened up and the foot and the shoe of the wearer may be inserted from the rear with ease.

Figure 4:
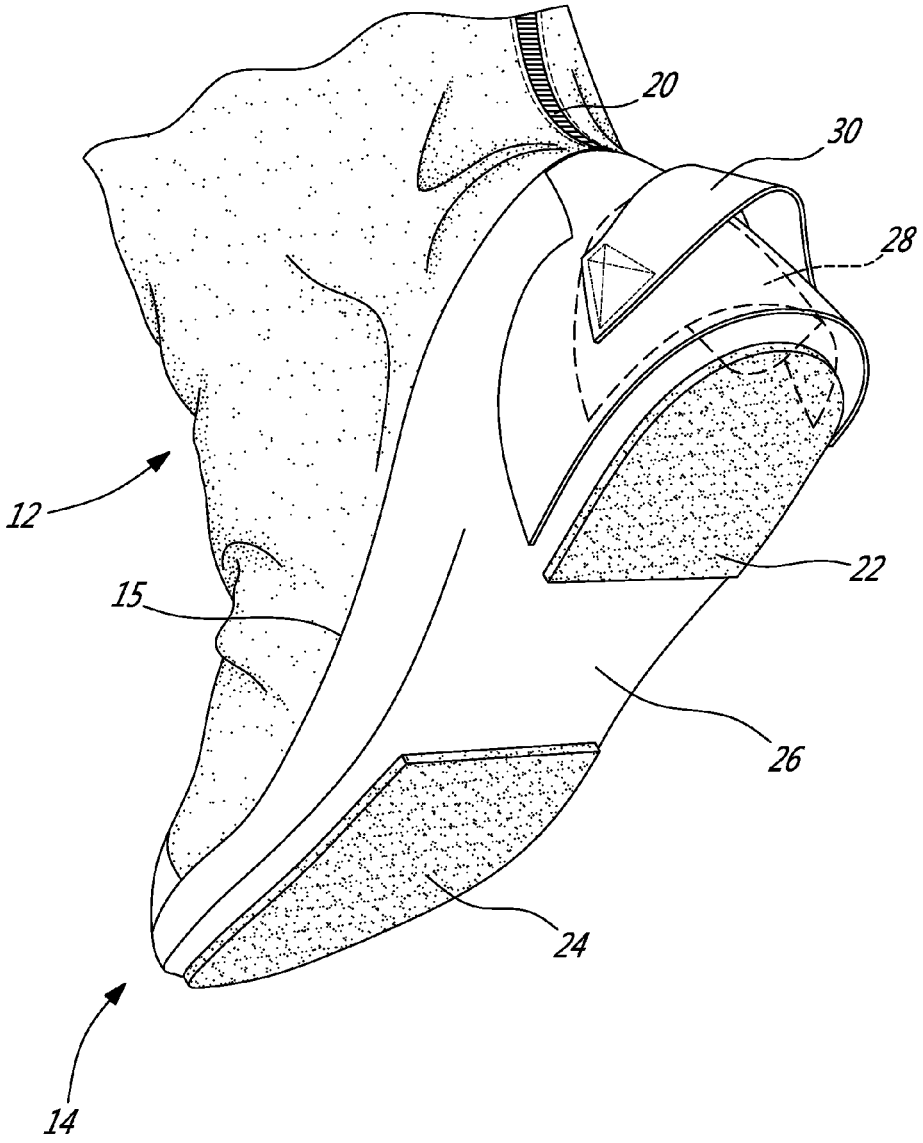
FIG. 4 is an enlarged bottom perspective view of the protective overshoe shown in FIG. 1.
Figure 5:
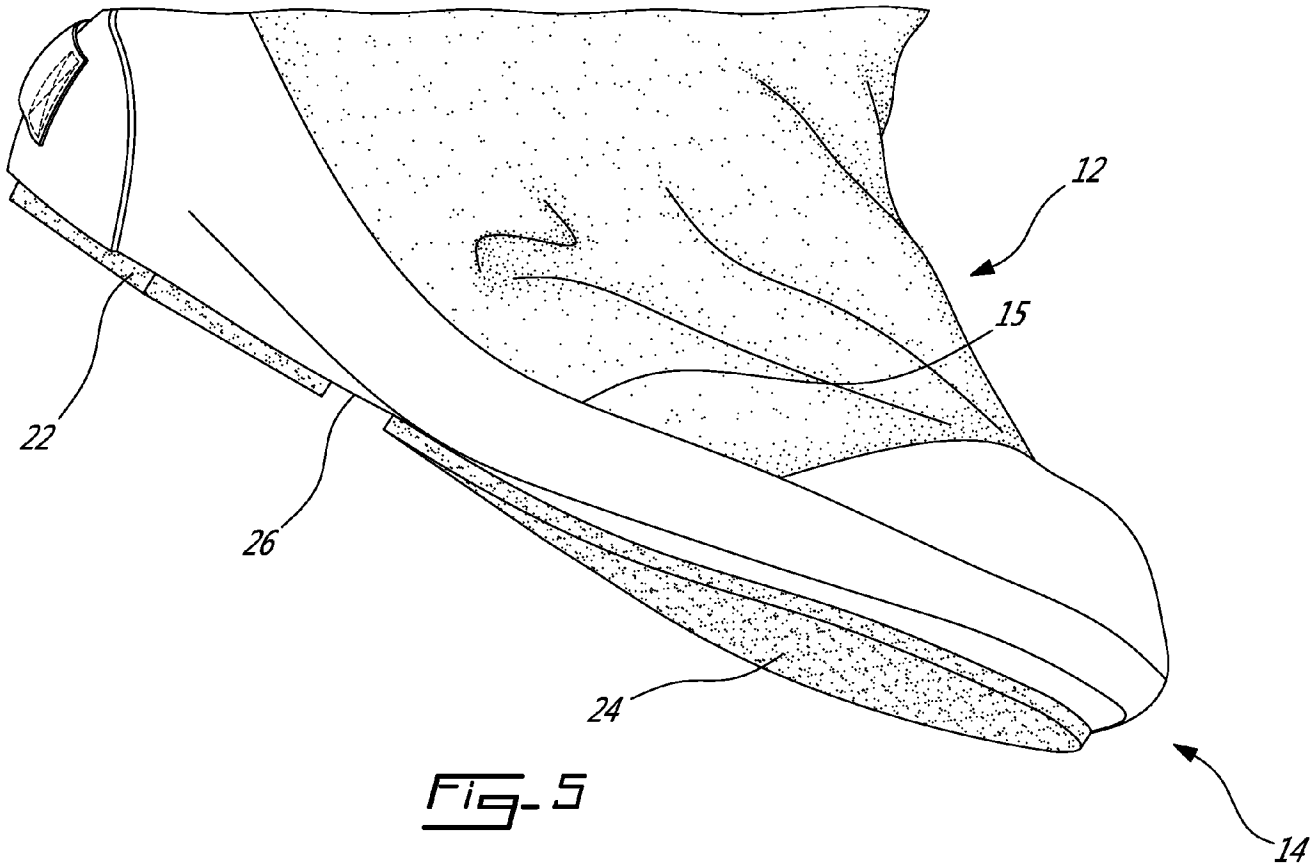
FIG. 5 is an enlarged side view illustrating details of a lower portion of the overshoe.

Now referring concurrently to FIGS. 1, 3 to 5 an 7 to 9, it can be appreciated that the stretchable lower portion 14 is adapted to snugly fit around the wearer's shoe. The lower portion 14 is continuous in length and width and adapts above the toe, and along the inner and outer surfaces of wearer's shoe or boot rendering a snug three dimensional fit. The lower portion 14 is stretchable lengthwise and widthwise to fit different sizes of shoe. As best shown in FIGS. 4 and 5, the lower portion 14 may have a three-piece sole comprising a heel portion 22, a toe portion 24 and an intermediate portion 26. The heel portion 22 and the toe portion 24 are separated from one another by the intermediate portion 26. The heel and toe portions 22 and 24 may both be made out of rubber or other suitable anti-slip materials. The heel and toe portions 22 and 24 may both be provided on an undersurface thereof with a thread pattern to provide better traction on slippery surfaces. The heel and toe portions 22 and 24 constitute the walking surfaces and are thus made of a sturdier material compared to the material composing intermediate portion 26. The intermediate portion 26 may be made out of a stretchable material which can be readily collapsed to allow the heel and toe portions 22 and 24 to be folded one over the other. For instance, the intermediate portion 26 could be made out of waterproof stretchable fabric material. In fact, the lower portion 12 could be provided in the form of a soft pliable fabric body integral to the upper portion 12 with two separate sole portions attached to the undersurface thereof. Other suitable reinforcing inserts could be provided at the front and the back of the lower portion 14. In any event, the lower portion 14 is constructed so that it can be collapsed with the separate front and rear sole walking supports 22 and 24 overlying each other.

Figure 6:
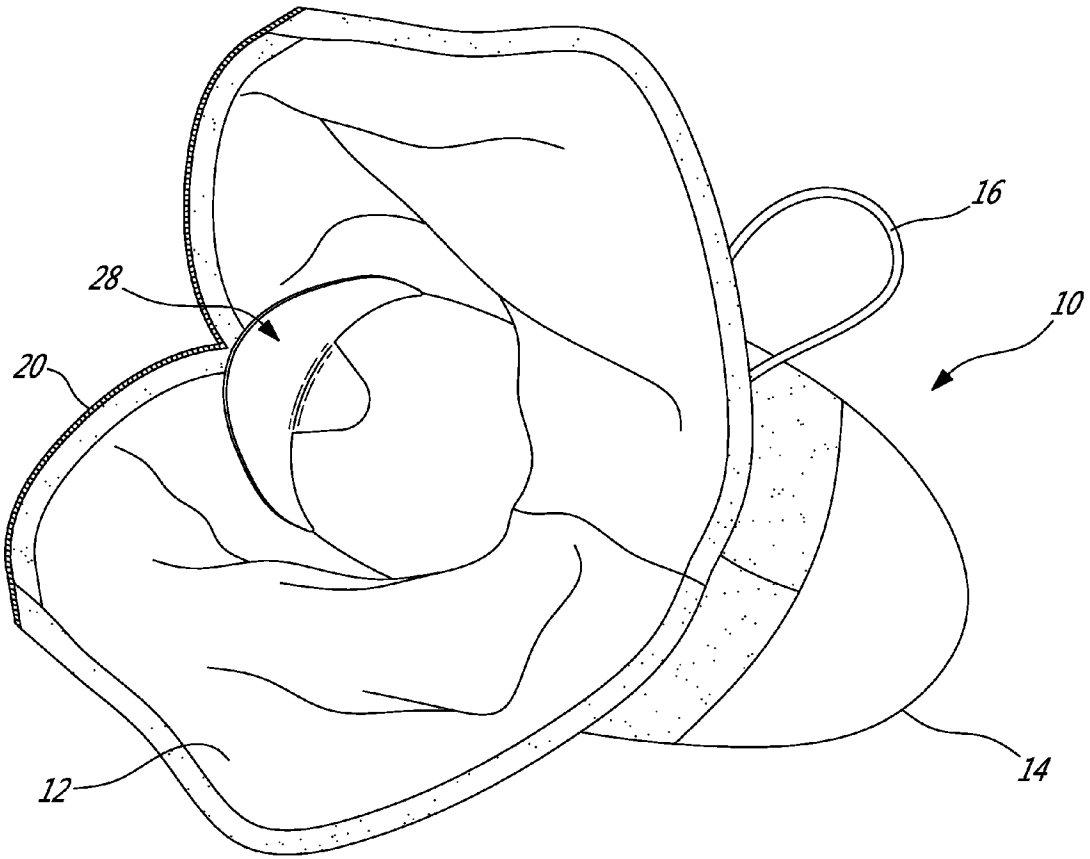
FIG. 6 is a top interior view of the protective overshoe shown in an open position and illustrating a rigid heel insert that limits the inward collapse of the overshoe body when longitudinally stretched, as during the insertion process of a shoe in the overshoe.
Figure 9:
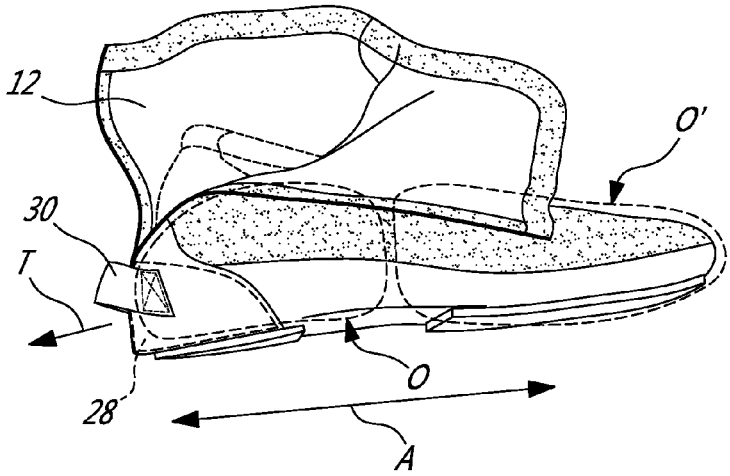
Figure 10A:
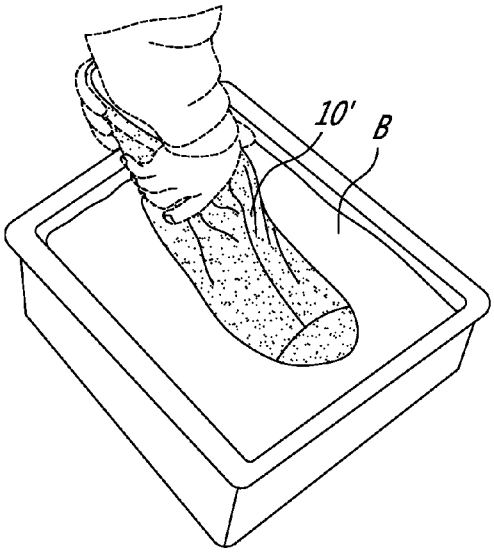
FIGS. 10*a* to 10*d* illustrate a rubber dipping process that may be used to build a rubber lower portion, including an outsole, directly on a fabric overshoe substructure.
Figure 10B:
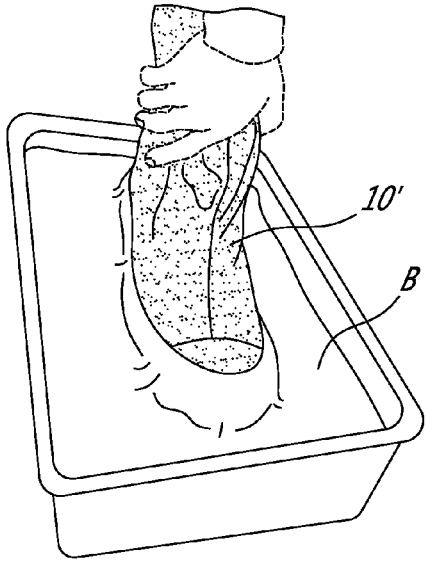
Figure 10C:
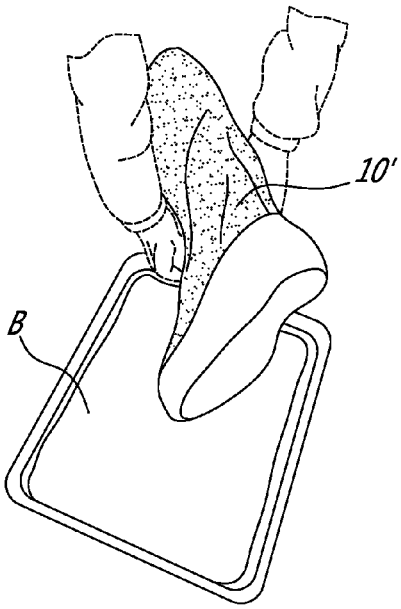
Figure 10D:
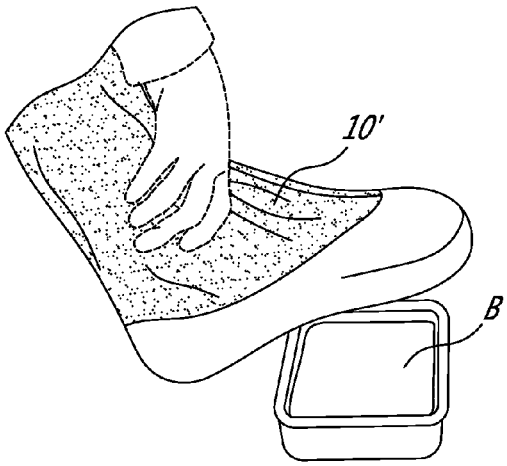
Figure 13:
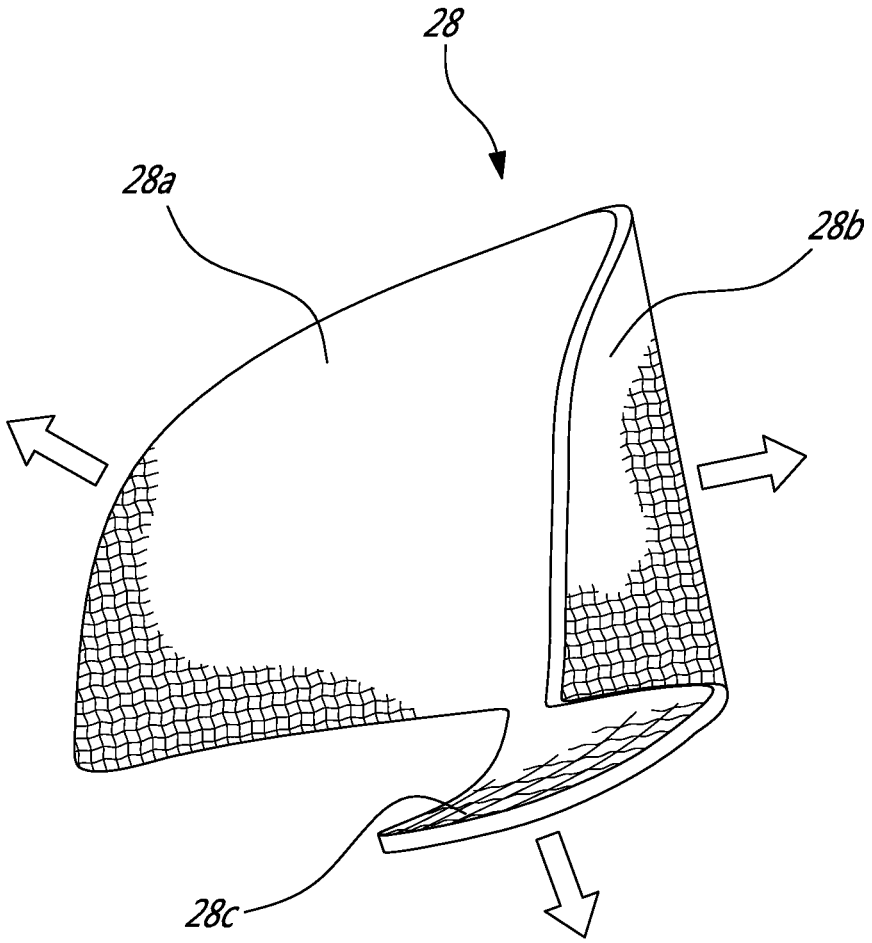
FIG. 13 is a perspective view of an embodiment of the heel insert shown in FIG. 6.

As show in FIGS. 6, 9 and 13, the lower portion 14 further comprises a substantially rigid heel insert 28 for covering the sides and back of the heel of the wearer's shoe. The heel insert 28 is adapted to clip tightly around the heel of the wearer's shoe, thereby limiting relative movement between the overshoe 10 and the wearer's shoe when walking. As will be seen in more details below, a pull tab 30 may be provided at the rear of the lower portion 14 of the overshoe to selectively spread open the heel insert 28 in order to facilitate placement of the shoe in the overshoe 10. The pull tab 30 is suitably connected to the hell insert so that when a user pulls on the tab, the force is transferred to the heel insert, thereby allowing the user to spread the heel insert to an open position suitable for receiving the hell portion of the wearer's shoe. For instance, the heel insert 28 could be attached to the inside surface of the soft shell overshoe and the pull tab could be provided in the form of finger loop attached to outer surface of the soft shell directly behind the opposed sides of the heel insert so that when a backward pulling force is applied on the finger loop, the opposed lateral sides of the heel insert are pulled backwards too, thereby opening the heel insert to facilitate the entry of the heel portion of the shoe into the overshoe.

Referring more particularly to FIG. 13, it can be seen that the heel insert 28 may comprise a pair of lateral wings 28*a* and 28*b* and a bottom wing 28*c* extending integrally forwardly from a back web portion. The heel insert may consist of a single piece of resilient material. For instance, the heel insert may be made out of a substantially hard piece of acrylic. According to another embodiment, the bottom wing 28*c* could be omitted. The heel insert may be placed internally or externally of the overshoe shell. Various ways may be used to attach the heel insert to the soft material of the overshoe shell. According to the embodiment shown in FIGS. 6 and 9, the heel insert is disposed inside the soft shell of the overshoe. For instance, the heel insert may be glued to the inside surface of the soft shell overshoe so as to be in direct contact with the wearer's shoe. Such an internal placement provides for a "shoe-horn" effect to facilitate the entry of the shoe into the overshoe. Upon wearing the overshoe, the heel portion of the wearer's shoe hits the harder heel insert material, and then slips on, adding to the ease of use. The bottom or inner sole wing 28*c* is added to benefit this feature, as the overshoe stretched, the bottom wing flattens out, creating a longer piece of material to act like a shoehorn. And once the heel of the wearer's shoe fits in place, the bottom wing 28*c* folds back, re-establishing the closure/bottom border of the overshoe and locking the shoe in place.

Figure 7:
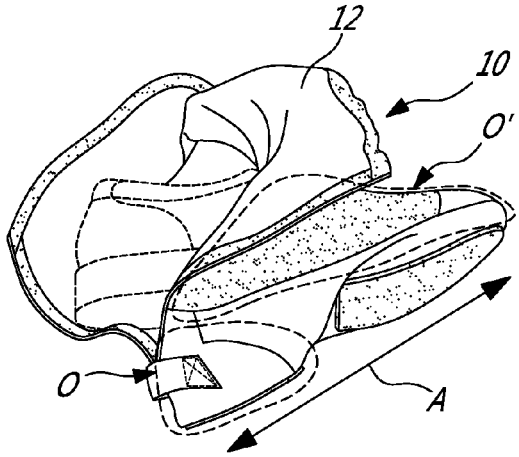
FIGS. 7 to 9 are sequential views illustrating the insertion of a shoe within the protective overshoe.

When stretching a sole longitudinally as depicted by arrows A in FIGS. 7 and 9, an invariable force is established that has an effect on the soft material to collapse inwardly (see arrows C in FIG. 8), thus limiting the ability to easily place ones shoe. In order to make a collapsible overshoe with a soft shell functional, this inward collapsing force (particularly at the heel opening) must be countered. In order to limit this inward collapse, a material with greater resistance is used. The heel insert 28 increases the rigidity and provides the required form holding properties to maintain an unobstructed heel opening while stretching the sole thereof for purpose of application and removal. Moreover, as opposed to a stretchable/pliable material which would provide inherent friction as the shoe is placed and removed, the heel insert provides a "shoehorn" like effect while placing and removing a shoe, directly enhancing the use of the product.

Figure 8:
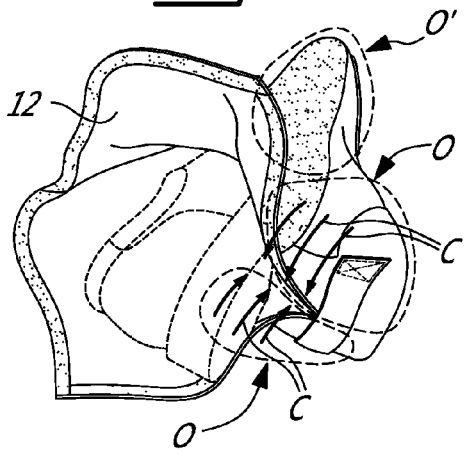

FIGS. 7 to 9 illustrate a shoe in the process of being fitted in a soft shell overshoe. First, the slide faster 20 is slid down to fully open the slit at the back of the overshoe 10. Then, the user can tear on pull tab 30, as depicted by arrow T in FIG. 9, while pushing the shoe forward into the lower portion 14 of the overshoe 10. During this entry procedure, the sole of the overshoe 10 is stretched longitudinally as depicted by arrow A. The resultant force will cause the material in the encircled areas O and O' to collapse inwardly. However, due to the inherent nature of the wearing process and the shoe being inserted within the overshoe, the areas O' are prevented from collapsing inward. At the back of the overshoe 10, the shoe is not yet inside the overshoe and, thus cannot counter the inward collapsing forces. Accordingly, as shown in FIG. 8, both areas O on either side of the rear opening will tend to collapse inwardly. This inward collapse is countered by the heel insert 28, thereby rendering the stretchable, collapsible overshoe functional and wearable. The rigidity of the material used for the heel insert 28 is selected to counter the lateral collapsing forces acting on the otherwise unsupported rear area of the overshoe. The heel insert 28 allows maintaining the rear opening wide open during all the shoe entry process. Moreover, as mentioned hereinbefore the heel insert 28 is also used in creating a shoe-horn like effect, as during function, it hits the heel of the shoe and permits ease of placement and removal.

The pull tab 30 on the back of the overshoe is used during the shoe insertion process to stretch and apply the force on the lateral wings 28*a* and 28*b* of the heel insert 28. By pulling rearwardly on the tab, the lateral wings of the heel insert are spread open in a backward direction, thereby holding the heel insert in an open position suitable for receiving the heel portion of the shoe. Once, the heel portion of the shoe has been properly positioned between the lateral wings of the heel insert 28, the pulling action on the tab 30 can be released, thereby allowing the lateral wings to spring back towards their rest position against the sides of the heel portion of the shoe. Once worn, the lateral wings 28*a* and 28*b* contributes to hold the wearer's shoe in place inside the overshoe.

Figure 11:
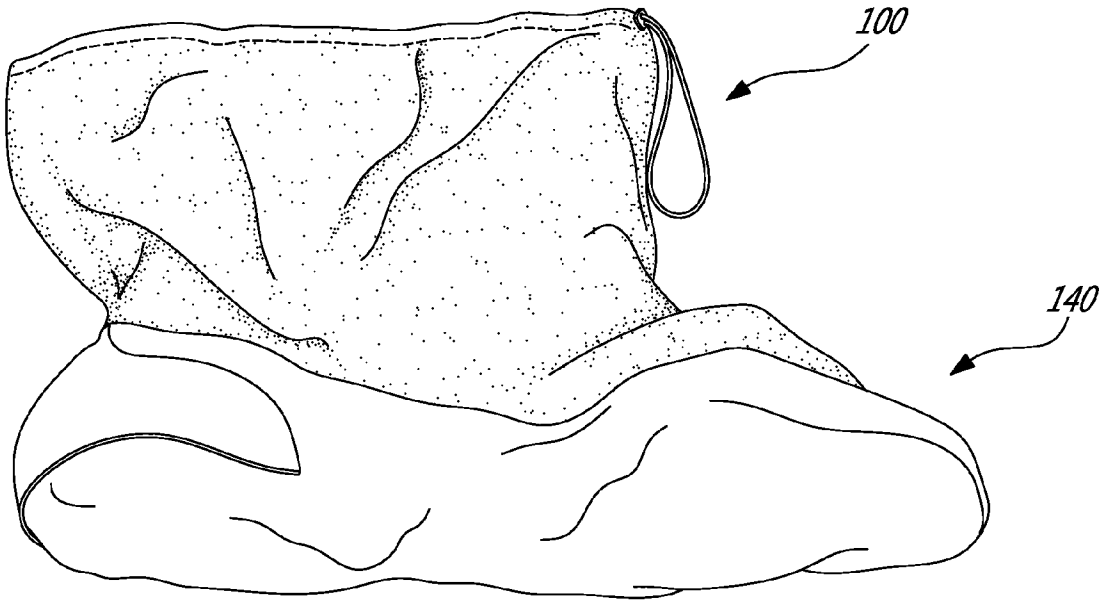
FIGS. 11 and 12 show examples of different overshoes having rubber coated lower portions.
Figure 12:
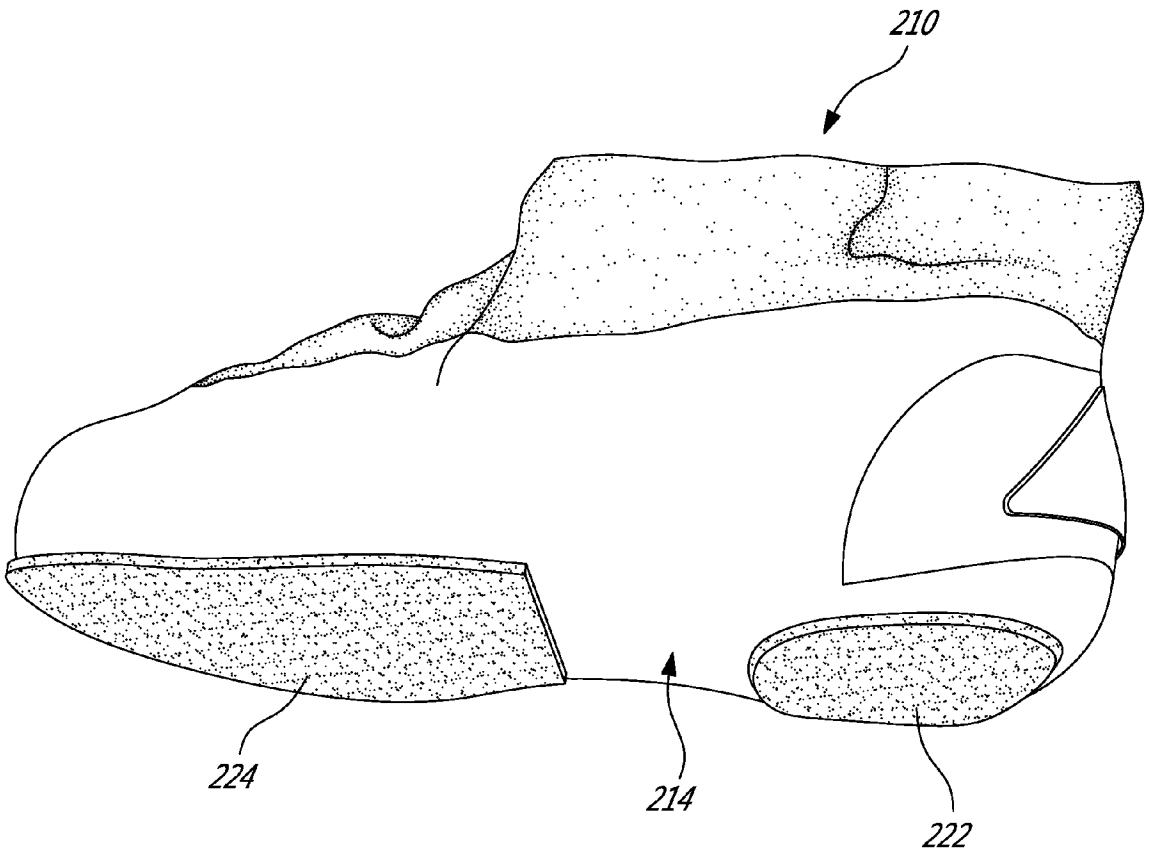

Referring now to FIGS. 10 to 12, one possible manufacturing method of the overshoe will be described. It is herein proposed to build the waterproof lower portion, including the outsole, directly on an overshoe substructure or template. This can be achieved by forming a fabric overshoe substructure 10' by union of separate lower and upper fabric portions, or in the form of a unitary sock-like member and by then applying a coating to at least the lower portion of the fabric overshoe substructure 10'. In this manner of fabrication, the substructure is joined prior to the dipping, and the rubber may be applied above the level of attachment of the upper and lower portions. This eliminates the requirement for further waterproofing of seems, and strengthens the union of the portions. The overshoe substructure may be provided with a heel insert, a slide fastener and a drawstring as described herein above in connection with FIGS. 1 to 9. As shown in FIGS. 10*a* to 10*d*, the fabric overshoe substructure 10' may then be fitted over a form or last which is generally shaped like the human foot and then the overshoe substructure 10' may be dipped into a bath of liquid rubber B or other suitable material. The overshoe substructure 10' is then removed from the bath of liquid rubber B, transferred in an oven and allowed to cure. Depending on the desired coating thickness and properties, the above dipping and curing procedures may be repeated a predetermined number of times. It is understood that the bath of liquid rubber B could comprise a mixture of different rubber materials. Also additives may be added to the mixture to obtain desired properties. Other suitable coating material may be used as well.

FIG. 11 shows an overshoe 100 fabricated with the above described rubber dipping process. It can be appreciated that the lower portion 140 (including the outsole) of the overshoe 100 is provided in the form of a rubber coating applied to a fabric sock-like member.

FIG. 12 illustrates a further example in which separate heel and toe outsole portions 222 and 224 are attached to the undersurface of a rubber coated lower portion 214 of a fabric overshoe substructure 210.

The above described overshoe design provides the pattern of material collectiveness required to achieve a stretchable sole, along with a non-stretchable upper portion and a rear opening design. The above description is meant to be exemplary only, and one skilled in the art will recognize that changes may be made to the embodiments described without departing from the scope of the invention disclosed. For example, the slide fastener could be replaced with other type of closures, such as hoop and loop type fasteners. Still other modifications which fall within the scope of the present invention will be apparent to those skilled in the art, in light of a review of this disclosure, and such modifications are intended to fall within the appended claims.

The invention claimed is:

1. A protective overshoe comprising a soft waterproof fabric upper portion extending from a lower portion including a stretchable sole structure, the lower portion being adapted to accommodate a wearer's shoe, the stretchable sole structure comprising a rubber coating applied on an underlying fabric structure integral to the soft waterproof fabric upper portion, a heel insert attached to the lower portion within the confines of a heel region thereof, the heel insert providing resistance against inward collapsing of the stretchable sole structure when subject to longitudinal stretching forces, the heel insert including a pair of lateral resilient wings adapted to clip around a heel portion of a wearer's shoe, and a pull tab attached at the back of the lower portion of the protective overshoe and connected to the lateral resilient wings of the heel insert to spread said lateral resilient wings backward away from each other during placement of the wearer's shoe inside the protective overshoe.

2. The protective overshoe as recited in claim 1, further comprising a closure extending vertically along the back of the overshoe down to the heel region of the lower portion.

3. The protective overshoe defined in claim 1, including separate heel and toe outsole portions on the rubber coating.

4. The protective overshoe defined in claim 1, wherein the lateral wings form a shoehorn on the inside of the lower portion of the overshoe, and wherein the heel insert has a bottom wing cooperating with the lateral wings to further facilitate positioning of the wearer's shoe inside the overshoe.

5. The protective overshoe defined in claim 1, wherein the heel insert and the pull tab are both attached to the underlying fabric structure of the lower portion of the overshoe.

6. A collapsible overshoe comprising a soft collapsible shell having a stretchable lower portion configured to accommodate a wearer's shoe, a heel insert attached to said lower portion in a heel region thereof, the heel insert being more rigid than said stretchable lower portion, the heel insert having a pair of opposed lateral wings adapted to clip around a back portion of the wearer's shoe, and a pull tab connected to said heel insert for pulling said lateral wings apart to a position in which said lateral wings provides for a substantially unobstructed entry the back portion of the wearer's shoe between said lateral wings.

7. The collapsible overshoe as recited in claim 6, further comprising a stretchable sole provided in the form of a rubber coating applied on the lower portion of the soft collapsible shell.

8. The collapsible overshoe as recited in claim 6, wherein the soft collapsible shell has a one-piece fabric sock-like member with a waterproof coating.

9. The collapsible overshoe as recited in claim 6, wherein the soft collapsible shell comprises a substructure including an upper tubular fabric portion adapted to feet around the wearer's leg and a lower fabric portion attached to the upper tubular fabric portion for receiving the wearer's shoe, and a rubber coating applied at least to the lower fabric portion.

10. The collapsible overshoe as recited in claim 9, wherein the upper and lower portions are joined at a seam, and wherein said seam is covered by said rubber coating.

11. The collapsible overshoe as recited in claim 6, wherein a slide fastener extends vertically along a back of the soft collapsible overshoe down to heel insert.

12. The collapsible overshoe as recited in claim 6, wherein the heel insert further has a resilient bottom wing.

13. The collapsible overshoe as recited in claim 6, wherein the heel insert is disposed on an inner surface of the soft collapsible shell to provide a shoehorn like sliding surface for the wearer's shoe to move on.

14. The collapsible overshoe recited in claim 6, wherein the lower portion comprises separate heel and toe sole portions interconnected by a flexible and stretchable intermediate sole portion, the flexible and stretchable intermediate sole portion allowing the heel and toe sole portion to be folded one over the other.

* * * * *